US009232290B2

(12) United States Patent
Besay

(10) Patent No.: US 9,232,290 B2
(45) Date of Patent: Jan. 5, 2016

(54) COOLER WITH INTEGRATED AUDIO SYSTEM

(71) Applicant: Junior Horace Besay, West Palm Beach, FL (US)

(72) Inventor: Junior Horace Besay, West Palm Beach, FL (US)

( * ) Notice: Subject to any disclaimer, the term of this patent is extended or adjusted under 35 U.S.C. 154(b) by 256 days.

(21) Appl. No.: 13/936,668

(22) Filed: Jul. 8, 2013

(65) Prior Publication Data

US 2015/0010189 A1 Jan. 8, 2015

(51) Int. Cl.
*H04R 1/02* (2006.01)
*H04R 5/02* (2006.01)

(52) U.S. Cl.
CPC ..... *H04R 1/028* (2013.01); *H04R 2420/07* (2013.01); *H04R 2420/09* (2013.01)

(58) Field of Classification Search
USPC ..... 381/334, 87; 620/3.6, 3.61, 267, 620/440–446; 62/457.7; 220/592.01
See application file for complete search history.

(56) References Cited

U.S. PATENT DOCUMENTS 7,630,864 B2 * 12/2009 Shoenfeld ..... E05D 65/52 702/177
2008/0031483 A1 * 2/2008 Hill ..... F25D 23/12 381/334
2009/0279722 A1 * 11/2009 Lin ..... H04R 5/04 381/311

* cited by examiner

*Primary Examiner* — Vivian Chin
*Assistant Examiner* — Ammar Hamid
(74) *Attorney, Agent, or Firm* — Christopher J. VanDam, P.A.; Chris Vandam

(57) ABSTRACT

A combination cooler and audio system device is described which is configured to insulate foods and beverages while simultaneously emitting audio from at least one onboard speaker. The device is equipped with a Bluetooth radio configured to interface with an audio device such as a cell phone or Mp3 player over conventional Bluetooth wireless frequencies. The device also has a wireless remote control, storage drawer, and solar powered lighting.

7 Claims, 7 Drawing Sheets

COOLER WITH INTEGRATED AUDIO SYSTEM

FIELD OF THE PRESENT INVENTION

The present invention relates to insulated food and beverage containers, and more specifically, those containers large enough to carry a multitude of items. Similarly, the present invention relates to audio or speaker systems, generally including multi-functional audio systems that are portable and preferably battery powered.

BACKGROUND OF THE PRESENT INVENTION

Conventionally, it is known that people enjoy music even when away from their home stereo or car stereo. The advent of the portable audio market in the 1980's has continued to advance today. In modern times, digital audio players and most cell phones are capable of playing music, and some are even capable of wirelessly transmitting the audio to wireless speakers of a vehicle or home sound system via conventional Bluetooth or WiFi wireless technologies. Unfortunately, in some hazardous or outdoor conditions, the use of these devices can be prohibitive to their durability.

For example, places with hazardous conditions are conventionally known not to be conducive to a long lifespan of a portable electronic device such as a cell phone or iPod™ without appropriate protection from the elements. For example, the water found at beaches and pools can damage most electronics without proper casings. A rain delay during an outdoor sport such as beach volleyball, soccer, Frisbee, or football can easily cause many portable audio electronics to fail and short circuit due to water damage without adequate protection.

Additionally, at beaches and pools, many people like to bring beverages and/or food with them in a cooler. The cooler effectively insulates the beverages and keeps them at an ideal temperature for a long period of time. Given that many people bring portable speakers to pools and beaches as well, conventionally individuals are required to bring both a cooler and a speaker system to their destination. If the two devices were combined, individuals would no longer have to carry both items to their destination.

Thus, there is a need for a combination cooler and audio system device, capable of interfacing with a portable audio device such as an Mp3 player, cell phone, CD player, iPod™, Mini-Disc™ player, or other electric device capable of playing audio, while simultaneously protecting the portable audio device from shock or environmental damage.

SUMMARY OF THE PRESENT INVENTION

The present invention is a portable insulated cooler and a music system that is fit for the beach, pool, park, camp sites, while hiking, at the workshop and other conventional, potentially hazardous locations. The music system is preferably equipped with at least two integrated speakers capable of providing stereo sound to the surrounding radius, which are interfaced with a conventional amplifier and AM/FM tuner with a modal switch. The music system of the present invention is equipped with a Bluetooth radio capable of establishing peer-to-peer connections to other Bluetooth capable devices within a surrounding radius in order to stream music from a digital audio device wirelessly. Similarly, the music system is also preferably equipped with a conventional 3.5 mm audio input auxiliary port (AUX), providing the capacity for the music system of the present invention to play audio directly from audio devices unequipped with a Bluetooth radio such as conventional portable CD players and many .mp3/digital audio players.

The present invention is equipped with a portable tray that is inserted at the top of the cooler, which helps to prevent the user's hands from getting wet when reaching for a beverage. Additionally, the present invention is equipped with a SOLAR lighting system which helps the user locate his or her favorite drink at night. The present invention is preferably equipped with three 4½ inch speakers that project audible sound to a radius of 50 feet. The present invention is equipped with a conventional, high-capacity rechargeable battery housed within a weather-proof compartment. The batter may be charged via onboard solar panels, or directly via DC through a built-in micro USB port or a female DC connection.

Additionally, the preferred embodiment of the present invention is preferably equipped with a pull out drawer for extra waterproof storage. The storage drawer is designed to be large enough to securely carry items such as a cell phone, camera, mp3 player, CD player, or other audio devices. The drawer is ideally located at the bottom left side of the present invention.

DETAILED DESCRIPTION OF THE PREFERRED EMBODIMENT

Figure 1:
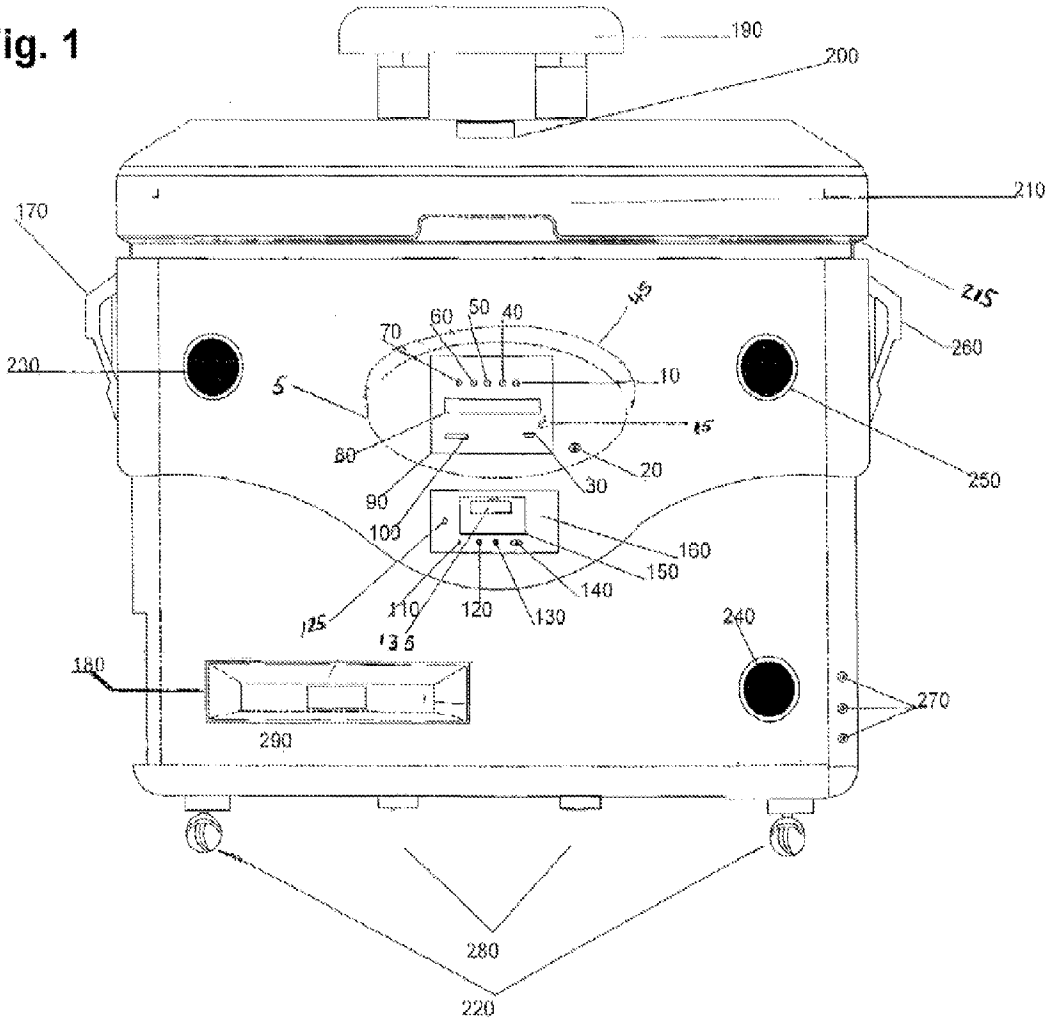
FIG. 1 depicts the present invention as viewed from the front.
Figure 2:
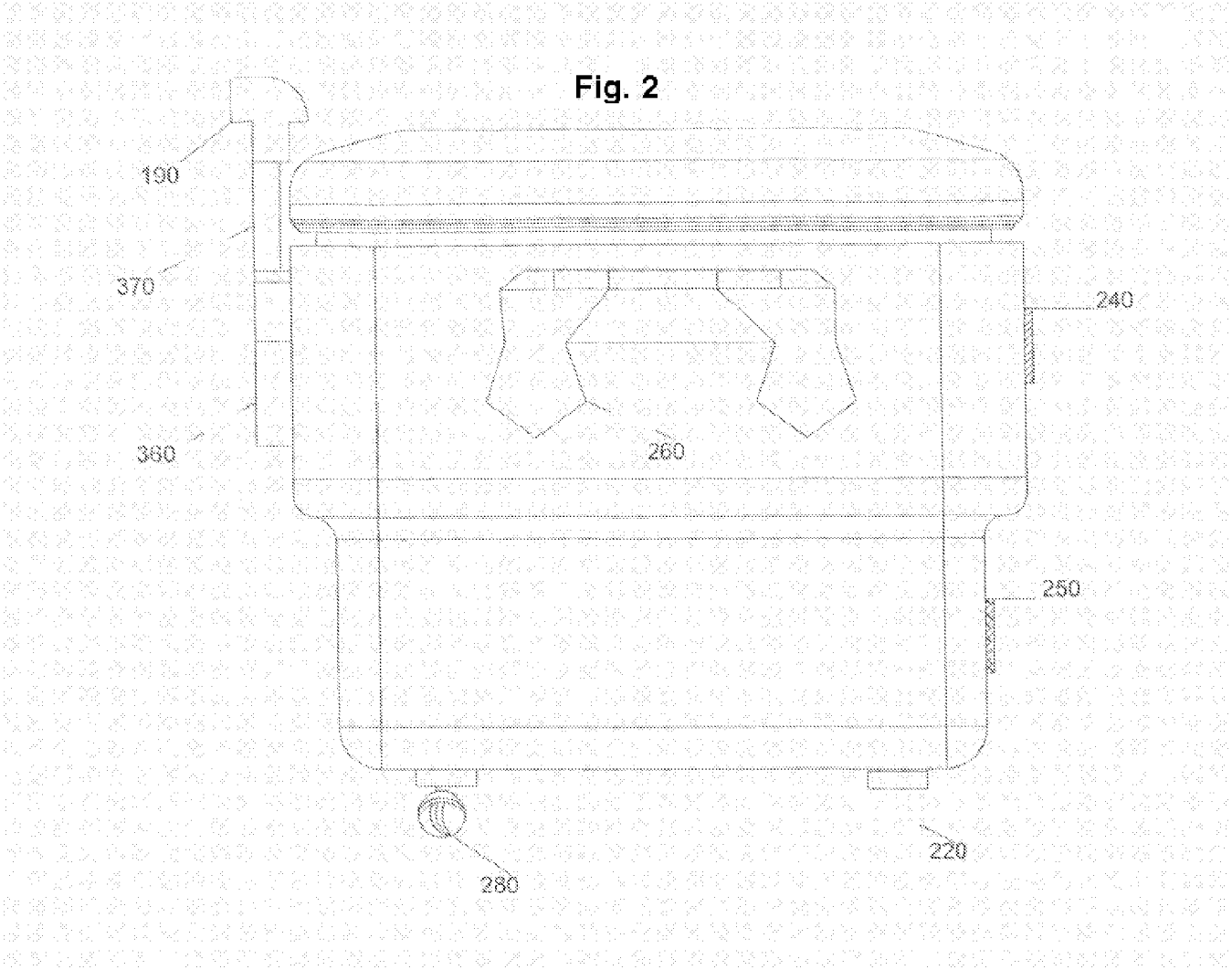
FIG. 2 shows the present invention as viewed from the right side.
Figure 3:
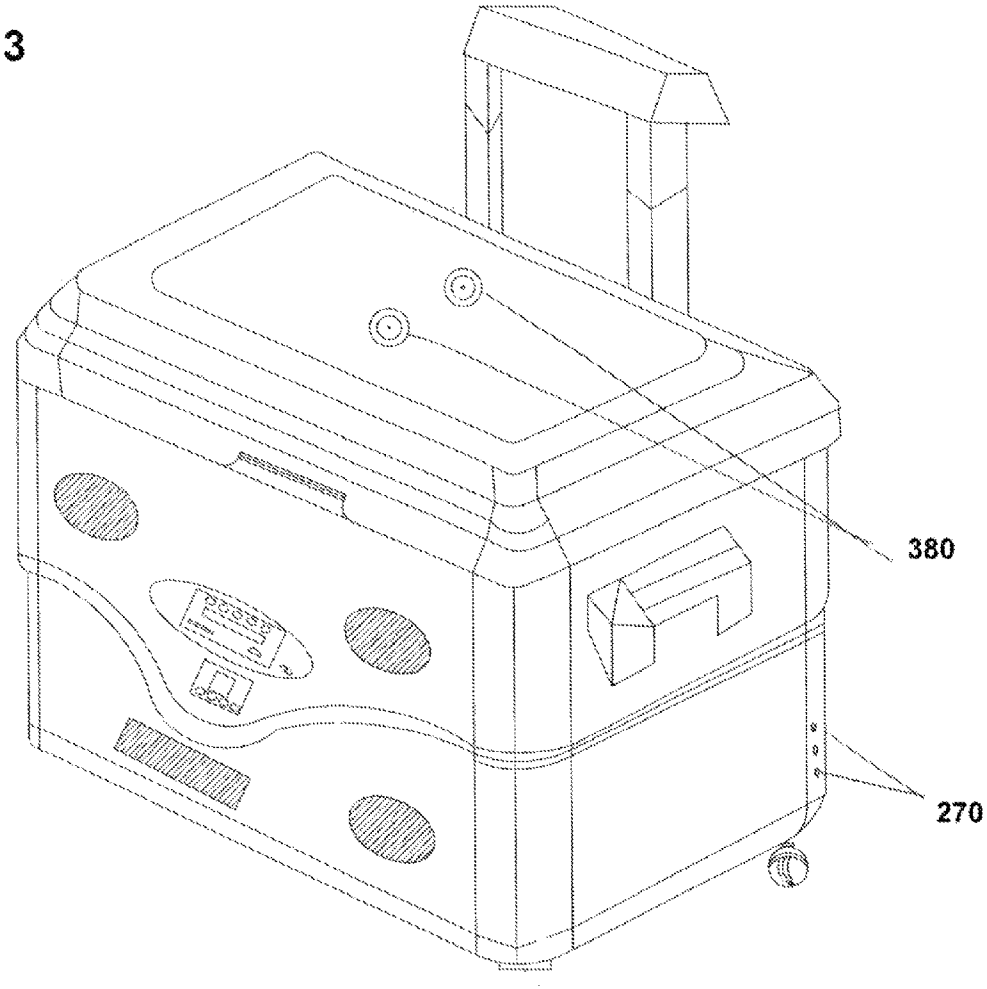
FIG. 3 exhibits an environmental view of present invention as viewed from the front.
Figure 4:
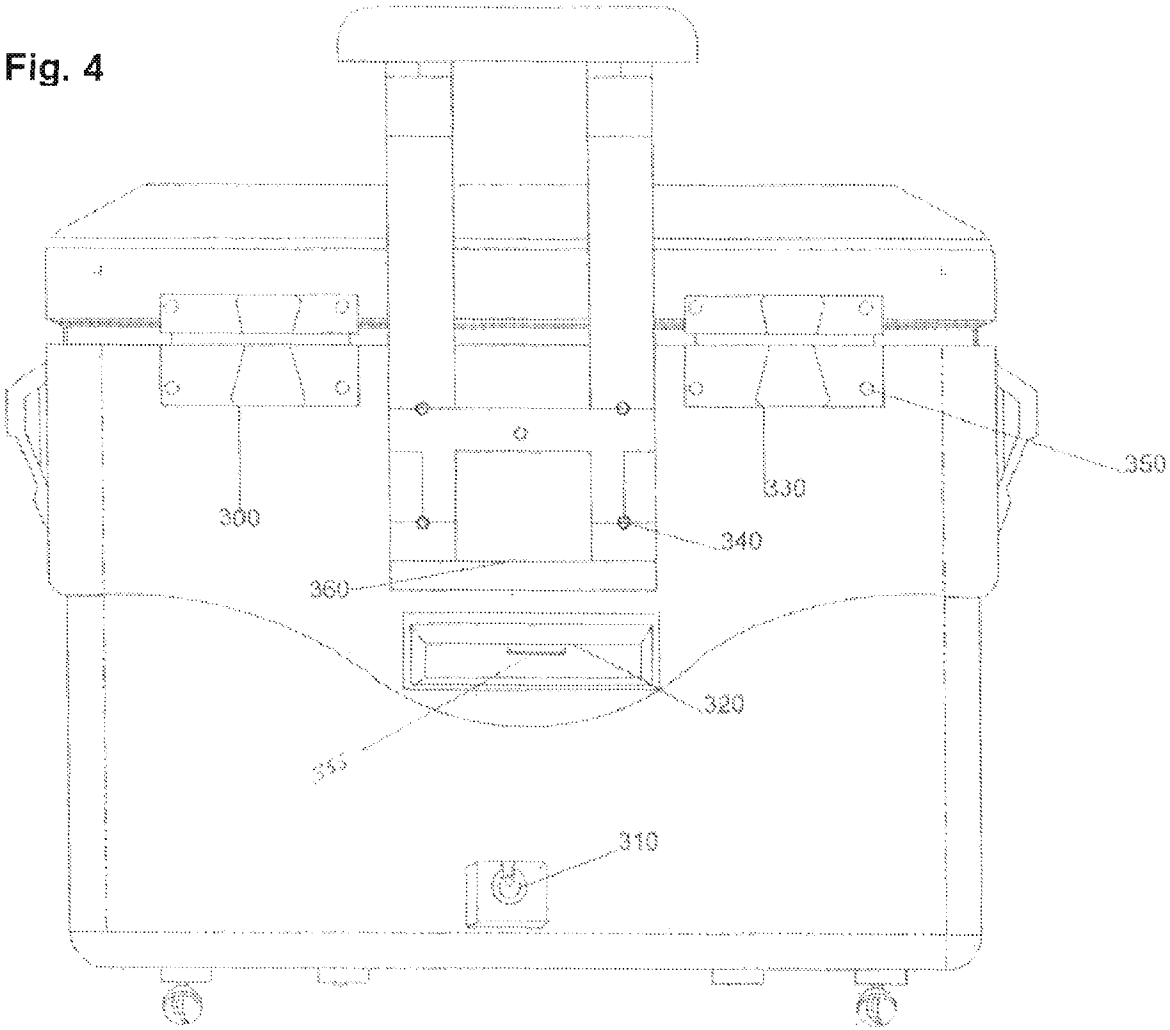
FIG. 4 details the present invention as viewed from the rear.

The present invention is a cooler equipped with an advanced sound system, as well as other features. The present invention has an insulated box which is designed to contain ice used for cooling or preserving food and beverages for long periods of time. Additionally, the present invention features a Bluetooth radio and sound system, equipped with at least one USB port (30) preferably disposed at the right rear end of the cooler. The at least one USB port (30) allows a user to charge a cell phone or other electronic device. Similarly, the present invention is preferably equipped with a memory card port (100), such as those conventionally designed to accept MMC (Multi-Media Card) and SD/XD memory cards. At least one speaker, including but not limited to a left top speaker (230) and a right top speaker (250) which are preferably integrated into the lid (330) of the insulated box of the present invention. Additionally, one speaker may be located on the bottom of the present invention. This additional speaker is referred to as the bottom right speaker (240).

The bottom of the insulated container is preferably equipped with a drawer (290) in the preferred embodiment of the present invention, providing space for the user to store items securely and free from water or other environmental damage. The present invention preferably has an aluminum housing configured to securely contain the electric elements of the audio system such as a battery, AM/FM tuner, internal antenna, amplifier, wiring, Bluetooth radio, and other conventional components. It is also preferably equipped with a plastic cover that is preferably clear in order to protect the present invention from water, sand, and other abrasive or destructive elements.

It is envisioned that some embodiments of the present invention may be equipped with at least one solar cell, envisioned to power at least one light (380). The at least one light (380) is preferably housed within the lid of the present invention. The at least one solar cell could also be configured to trickle charge the battery powering the speaker system and Bluetooth radio of the present invention.

The preferred embodiment of the present invention is preferably equipped with two wheels (220) located at the rear left and right bottom of the housing. To support the other two corners of the present invention, two small stands (280) are preferably located at the front of the present invention as an added safety feature, to keep the present invention level when at rest. The lid of the present invention is preferably equipped with a handle designed to conveniently swing up to facilitate transport of the present invention. The handle preferably folds flat when not in use.

The present invention is preferably configured to accept a wide variety of audio files such as .MP3, .OGG, .FLAC, .WMA, and other conventional audio formats. The audio files are preferably played from a USB memory stick, a Bluetooth connected iPod™, cell phone, or from a memory card. The present invention preferably supports conventional memory card formats and sizes, namely SD/XD/MMC memory cards. The audio system of the present invention may preferably be controlled with onboard control buttons or via an accompanying remote control.

The present invention preferably includes the following features:

A portable insulated cooler with built in Audio System:

Audio System, Bluetooth capability, USB Port.

Two cell phone charging outlet, SD Card Port/MMC Slot

Battery operated remote control

Solar light operated

The present invention is a portable insulated cooler with a built in aluminum base audio system for recreational use. The present invention has a unique feature designed to maintain a user's favorite beverage at an ideal temperature, and to keep the hands of the user dry when accessing the beverages. Additionally, the present invention is equipped with a built in Solar lighting system that charges the present invention in the day in order to provide for hours of night time use.

Features of the Invention:

1. USB Port
2. SD/MMC Card slot
3. Volume up-Fast Forward button
4. Play/Pause button
5. Volume down/Rewind button
6. Equalizer button
7. Mode button (370) features:

Bluetooth

USB Port

MMC Slot

AM/FM Radio

8. Remote infrared sensor (20) located on the right side of unit

Figure 5:
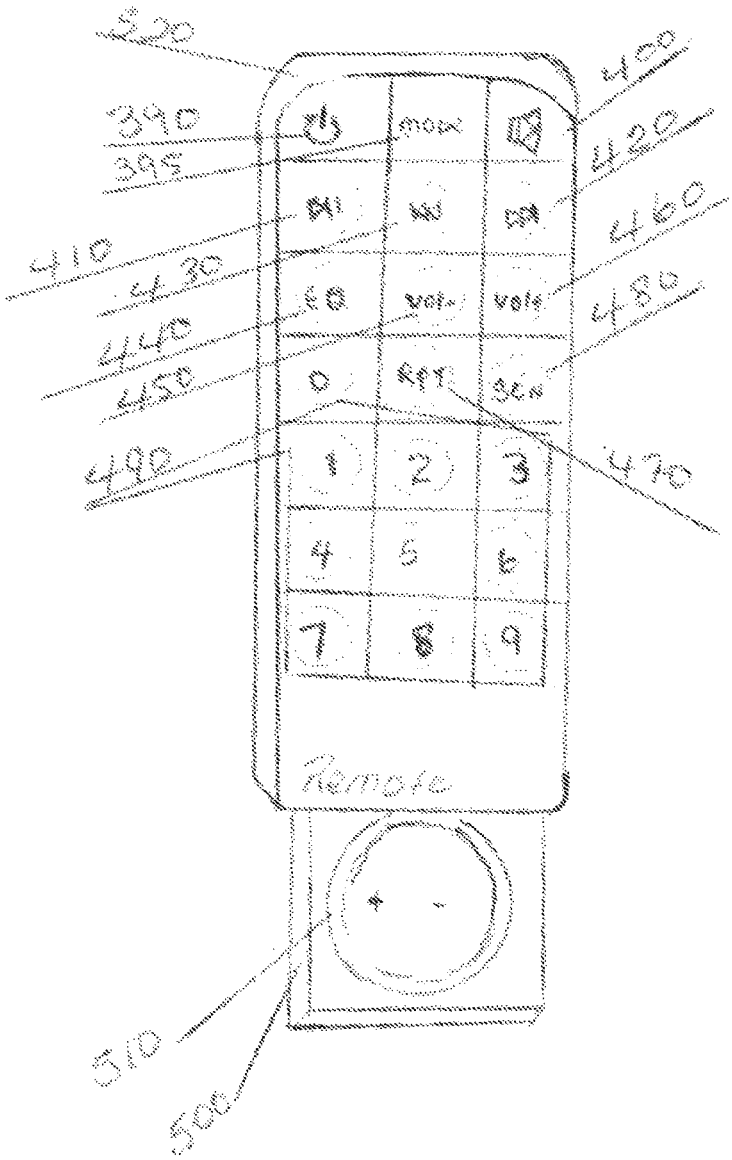
FIG. 5 shows the remote control of the present invention as seen from the front.
Figure 6:
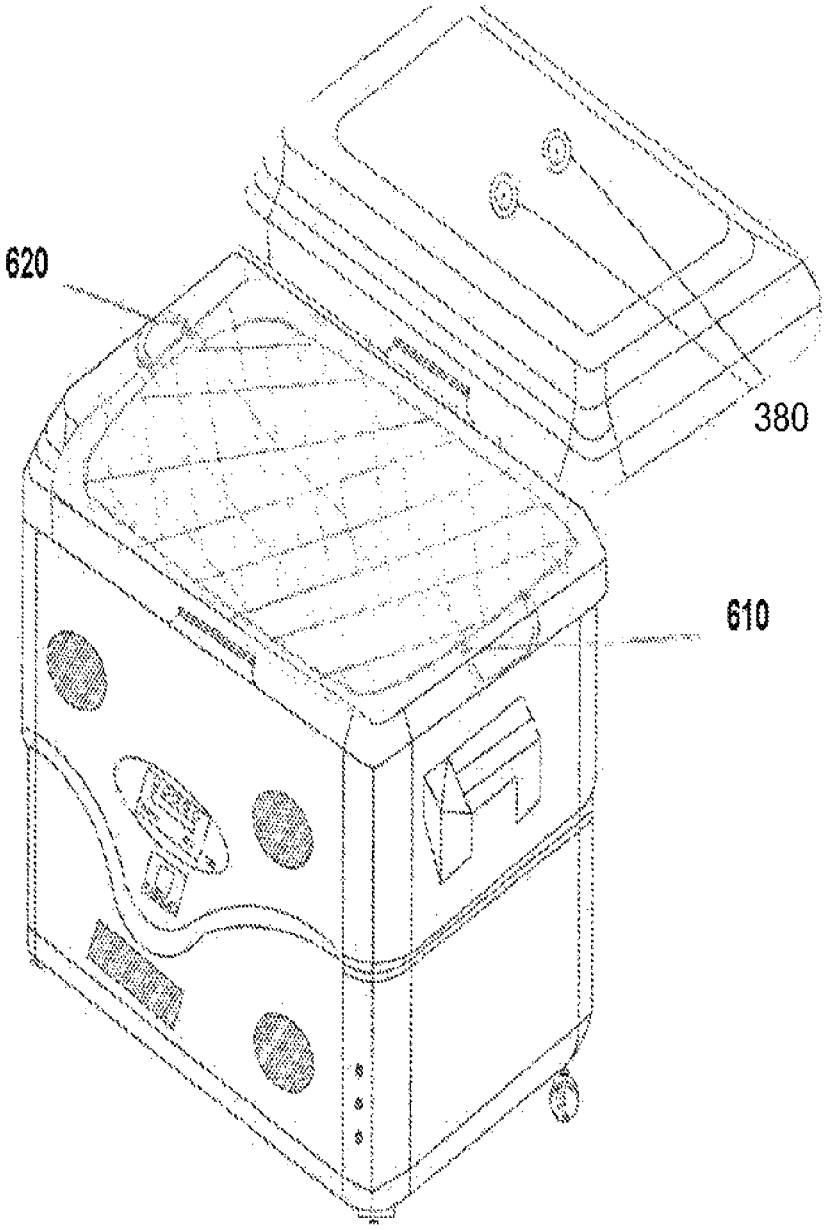
FIG. 6 depicts an environmental view of the present invention as viewed from front with the lid of the present invention in the open position.
Figure 7:
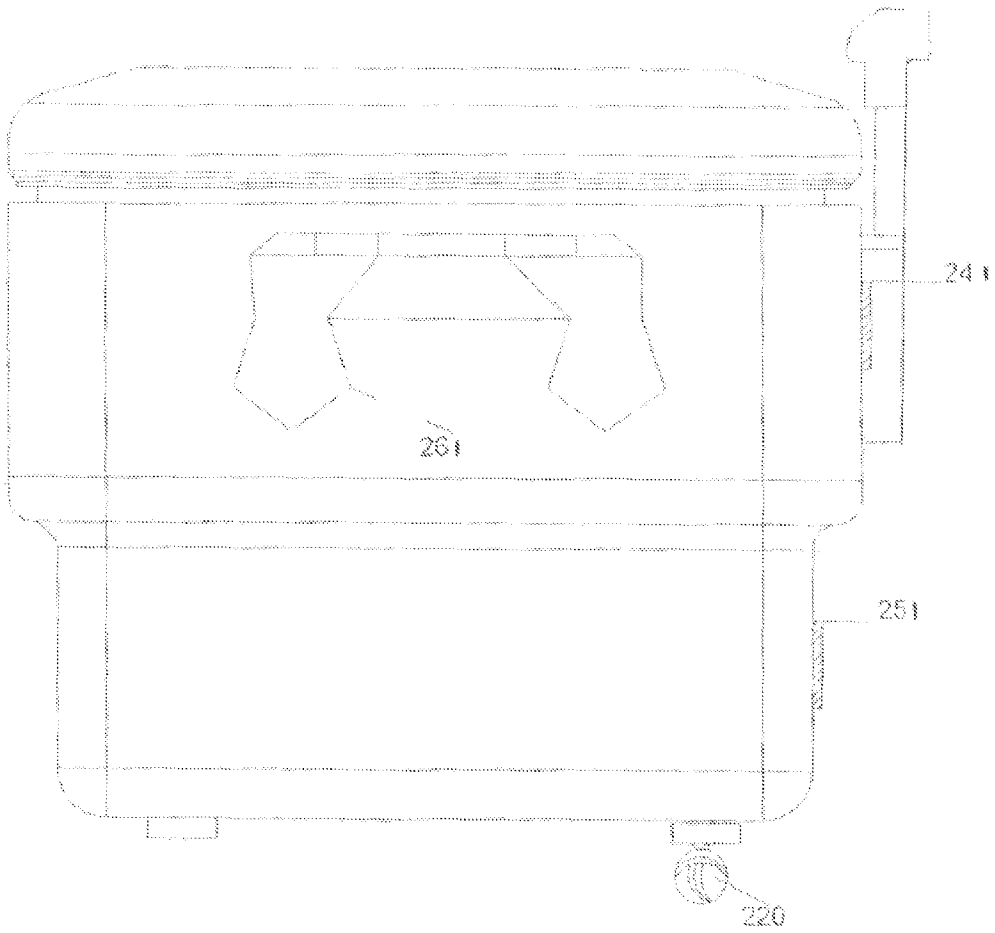
FIG. 7 exhibits the present invention as seen from the left side.

Remote Control Features:

The remote control, as seen in FIG. 5 is equipped with a variety of features designed to facilitate simple control of the present invention by the user from a distance. The majority of these features are conventional to standard remote controls. The features of the controls of the present invention preferably include the following:

1. Standby button (390)
2. Mode button (370)
3. Mute button (400)
4. EQ button (40)
5. Volume up/down button (330)
6. Rewind/Fast Forward button (350)
7. Search/Scan button (480)
8. Play/Pause button (310)
9. Numeric buttons, which may include potential digits 0-9.

It should be understood that the remote of the present invention may be equipped with fewer or additional features in alternate embodiments of the present invention.

EQ (Equalizer) Preset Mode Features:

EQ1—Country

EQ2—Jazz

EQ3—Pop

EQ4—Classic

EQ5—Rock

EQ6—Normal/No Preset

It should be noted that the above equalizer preset modes are cycled once for each press of the Equalizer button (440) of the present invention.

Battery Specifications and Installation

The battery employed by the present invention is preferably of high-capacity, and Main unit has a red & black rechargeable lion battery installed in front of unit.

Battery usage time . . . up to 5 hours of continuous play time.

Battery Life . . . 2 years

Max Charge Voltage: 4.2V

Battery: 3.7V/1000 mAh

Model No.: . . . Lyon J009

It should be understood that any conventional battery system could be adapted to power the present invention, and that larger capacity batteries may be employed in order to achieve longer output of audio. The battery is disposed behind a battery door (135) within a conventional, water-tight battery housing (500). In the event that multiple batteries are employed by the present invention, a second battery may be disposed behind a housing for rear battery (320).

P1. FM/AM telescopic built in/no antenna

2. The power on/off switch (140) of the present invention is preferably located on the front, as seen in FIG. 1.

3. Speakers on front of Cooler

4. Micro USB Port for charging

5. Aux in/out jack for IPod, MP3 player, Cell phone, etc. . . .

6. Battery door (135) located on front of the Cooler unit

7. The present invention is also equipped with a Bluetooth indicator (15), preferably located on the front of the present invention, which provides a visual indicator via a small light to the user when the Bluetooth radio of the present invention is paired with a Bluetooth audio device.

8. The present invention has a second rechargeable battery with a housing for rear battery (320) with a door opening (325) located at the back of the unit allowing you to charge up to two cells phone at the same time.

9. The present invention is preferably equipped a Charging indicator light (125) on the front to visually indicate to the user when the battery of the present invention is charging.

10. A Left top speaker (230) and a right top speaker (250) are preferably mounted and located on the front of the unit. One speaker located on the left and two speakers located on the right top and bottom of the present invention exist in some embodiments of the present invention.

Security concerns, such as the weather-proofing of the audio system of the present invention is primarily alleviated via a housing for battery (30), which is preferably constructed of a metal or metallic alloy, and sealed shut with a battery door (135). The invention has an audio unit mounted generally in the center of the cooler system. The audio system can only be accessed through the front. In all embodiments of the present invention, it is envisioned that the designed of the present invention is such that it ensures that the controls, SD/MMC media card slot (100), first USB port (30), second USB port (270) and other sensitive technical elements of the present invention are hidden from view and debris, thus protecting them from the outside environment. The face of the audio system is preferably flat and shrouded in a protective plastic covering over the aluminum housing.

The audio speakers are preferably capable of being heard at a distance of over 50 feet, depending on weather conditions. The volume can be controlled with the remote control which is configured to interface with a built-in infrared sensor (20). A Bluetooth remote could also be employed to control the present invention, which would conventionally not require line-of-sight to function, unlike the traditional infrared remote control of the present invention. The present invention can also be operated manually via series of buttons found on the body of the present invention. The infrared sensor (20) is waterproof and element safe (dirt, sand etc.). The present invention has an aluminum base drawer shrouded in hard plastic and is preferably insulated. The drawer allows for safe keeping of personal belongings (camera, keys, iPod, etc.) within an easy, slide-out container. The cooler has two solar lights which enable 24 hour usage. The cooler systems also has a second rechargeable battery that allows two USB ports (30) for charging two cell phone simultaneously located on center of the back of cooler, the two USB ports (30) are on the side of cooler.

FIG. 1 outlines many of the physical aspects of the present invention. For example, a first solar light located on top cover (10) and a second solar light (20) are shown, along with a set of hinges of a lid (30). A handle (60) for left right and left sides of the present invention is also shown. A first USB port (90) for cell phone charger can be seen at the bottom of FIG. 1. A second USB port (140) is preferably positioned above the first USB port (90). A drain (100) for cooler is located at center of back, and preferably configured with a sealable spout that is water-tight. A housing for rechargeable battery (110) of the present invention is also exhibited in FIG. 1 as disposed over the rechargeable battery. An expandable handle (170), second lid hinges (130), third hinge (120), and a seal (50) all conventionally envisioned, can be seen in their preferred positions in the figures as well. The seal of the present invention is preferably rubber or silicone and is air tight to prevent humidity build-up and sand or water damage. The present invention is preferably equipped with the following handles to facilitate comfortable transport of the present invention: a rear handle for pulling (190), a handle on the left (260), a rear handle bracket (360), a left swing handle (170) and a right swing handle (260). It is envisioned that the rear handle for pulling (190) is designed to be pulled on when the present invention is tipped to an angle so as to be resting on the two rear wheels (220).

Preferred embodiments of the present invention preferably include a micro USB female port (280), interfaced with the battery and configured to receive power from an external source for charging the battery of the present invention. Aux in/out port (300) capable of connecting manually to an iPod, cell phone, or other .Mp3 player, a charging indicator light (320) Play/pause button (310) Volume down/rewind button (330) Volume up/fast forward (350).

Mode button (370) of the device and the mode button (10) of the remote control cycle through modes including, but not limited to: blue tooth USB port AM/FM MMC (370) when pressed by the user. The equalizer button (40) provides for the user to switch between a variety of pre-programmed equalizer settings including optimizations such as EQ 1—Country, EQ2—Jazz, EQ3—Pop, EQ4—Classic EQ5—Rock, EQ6—No Effect/Natural (360)

ELEMENTS NOTED IN THE FIGS.

1. Radio Control Housing (5)
2. Rear Handle For Pulling (190)
3. USB PORT (30)
4. Extension of handle (370)
5. SD/MMC Card Slot (100)
6. Handle on left (260)
7. Volume/<<Button (50) Play/Pause Button (60)
8. Left speaker housing (245)
9. Volume+/>>Button (70)
10. Drawer base (255)
11. EQ(Equalizer) button (40)
12. Rear handle bracket (360)
13. Mode Button (10)
14. Infrared Remote Sensor(on Front of unit) (20)
15. Audio Unit Control Cover (45)
16. Two solar rechargeable light in lid (380)
17. FM Telescopic antenna (110)
18. Three USB port for charging
19. Power on/off switch (140)
20. Cell PHONE \MP3 (270)
21. Micro USB port for charging (130)
22. AUX in Jack (120)
23. Battery Door (135)
24. Stud for Bracket (340)
25. Bluetooth Indicator (15)
26. Housing for Rear Battery(320)
27. Charging Indicator (125)
28. Door Opening (325)
29. Left Top Speaker (230)
30. Drain Plug (310)
31. Right Top Speaker (250)
32. Left Hinge for swinging of Lid (300)
33. Bottom Right Speaker (240)
34. Right Hinge for swinging of Lid (330)
35. Two rear Wheel (220)
36. Stud for Hinge (350)
37. Drawer Housing (180)
38. Drawer Face (290)
39. Digital Screen (80)
40. Front Stands (280)
41. Left swing Handle (170)
42. Right swing Handle (260)
43. Lid opening (210)

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

I claim:

1. A cooler with an integrated audio system comprising: a Bluetooth radio signal receiver that receives a Bluetooth signal from an external digital audio device; a housing; at least one light that illuminates an interior of the cooler; a battery; at least one speaker; an audio amplifier contained within the housing; at least one solar panel; at least one USB charging port to charge an external device; an AM/FM radio and memory card port operably connected to the audio amplifier; wherein said at least one speaker is in communication with said audio amplifier and said battery; wherein said at least one light is powered by the battery; wherein said at least one solar panel is configured to charge the battery when light is present; and a lid, said lid equipped with a handle and configured to open a waterproof drawer dimensioned to contain personal electronic items is integrated into the housing.

2. The cooler with integrated audio system of claim 1, further comprising a means of charging the battery via AC/DC electricity.

3. The cooler with integrated audio system of claim 1, further comprising a Bluetooth indicator configured to alert when the Bluetooth radio is paired to an external digital audio device.

4. The cooler with integrated audio system of claim 1, further comprising a remote control configured to interface with an infrared sensor to control the integrated audio system.

5. The cooler with integrated audio system of claim 1, wherein said housing is equipped with at least one wheel.

6. A cooler with an integrated audio system comprising: a Bluetooth radio signal receiver that receives a Bluetooth signal from an external digital audio device; a housing; at least one light that illuminates an interior of the cooler; a battery; at least one speaker; an audio amplifier contained within the housing; at least one USB charging port to charge an external device; an AM/FM radio and memory card port operably connected to the audio amplifier; wherein said at least one speaker is in communication with said audio amplifier and said battery; wherein said at least one light is powered by the battery; wherein said battery is rechargeable from an external source of power; and a lid, said lid equipped with a handle and configured to open a waterproof drawer dimensioned to contain personal electronic items is integrated into the housing.

7. A cooler with an integrated audio system comprising: a Bluetooth radio signal receiver that receives a Bluetooth signal from an external digital audio device; an insulated housing surrounding a hollow interior; a top surface of the insulated housing includes an operable lid providing access to the hollow interior; at least one light that illuminates an interior of the cooler; a battery; at least one speaker; an audio amplifier contained within the housing; at least one USB charging port to charge an external device; an AM/FM radio and memory card port operably connected to the audio amplifier; wherein the speaker is in communication with the audio amplifier and the battery; wherein the light is powered by the battery; wherein the battery is rechargeable from an external AC or DC power source; the lid is equipped with a handle and configured to open the lid and allow access to the hollow interior; a Bluetooth indicator is configured to alert when the Bluetooth connected radio is paired to a digital audio device; a remote control is configured to interface with and to control the Bluetooth connected radio or audio amplifier; said housing is equipped with at least one wheel; a waterproof drawer dimensioned to contain personal electronic items is integrated into the case housing.

* * * * *